US006978704B2

(12) United States Patent
Cheng

(10) Patent No.: US 6,978,704 B2
(45) Date of Patent: Dec. 27, 2005

(54) LOCKING PLIERS

(76) Inventor: Hsiao-Yun Chen Cheng, 3F, No. 25-2, Lane 87, Sec. 3, Hsin-Sheng N. Rd., Chung-Shan Dist,Taipei City (TW)

( * ) Notice: Subject to any disclaimer, the term of this patent is extended or adjusted under 35 U.S.C. 154(b) by 57 days.

(21) Appl. No.: 10/806,626

(22) Filed: Mar. 22, 2004

(65) Prior Publication Data

US 2005/0204874 A1 Sep. 22, 2005

(51) Int. Cl.[7] ..... B25B 7/12
(52) U.S. Cl. ..... 81/369; 81/368; 81/370; 81/381
(58) Field of Search ..... 81/367–384, 129, 81/150, 153; 269/6, 201, 166, 228

(56) References Cited

U.S. PATENT DOCUMENTS 3,859,874 A * 1/1975 Joeckel ..... 81/367
3,958,468 A * 5/1976 Weller ..... 81/368
4,850,254 A * 7/1989 Burney ..... 81/367
D358,746 S * 5/1995 Neff ..... D8/52
6,626,070 B2 * 9/2003 Peperkorn et al. ..... 81/370

* cited by examiner

*Primary Examiner*—Lee D. Wilson
*Assistant Examiner*—Anthony Ojini
(74) *Attorney, Agent, or Firm*—Troxell Law Office, PLLC

(57) ABSTRACT

Locking pliers include a stationary front jaw, a stationary handle, a movable front jaw, a movable handle, an adjusting screw rod, and a locking lever. The movable front jaw is moved toward the stationary front jaw to clamp an object therebetween when the movable handle and the stationary handle are forcefully brought together by an external force applied thereto. A releasing lever for unlocking the movable front jaw and the stationary front jaw has a flex wall body with a substantially flat central portion and two opposite curved side portions flaring curvedly and upwardly from the flat central portion. The flat central portion has a width larger than the diameter of the adjusting screw rod.

2 Claims, 3 Drawing Sheets

LOCKING PLIERS

BACKGROUND OF THE INVENTION

1. Field of the Invention

This invention relates to locking pliers, more particularly to locking pliers with a releasing lever that is configured in such a manner so as to protect the user's fingers from being pinched by the releasing lever.

2. Description of the Related Art

Conventional locking pliers include a stationary front jaw, a stationary handle extending rearwardly from the stationary front jaw, a movable front jaw disposed below and aligned with the stationary front jaw and pivoted to the stationary handle, a movable handle pivoted to and extending rearwardly from the movable front jaw, an adjusting screw rod engaging threadedly a rear end of the stationary handle and having a rear end portion that extends outwardly from the rear end of the stationary handle, a locking lever pivoted to the movable handle and extending rearwardly and upwardly therefrom toward the rear end of the stationary handle to abut against a front end of the adjusting screw rod, a biasing member interconnecting the movable front jaw and the stationary handle, and a releasing lever pivoted to the movable handle and having a protrusion that protrudes therefrom to abut against the locking lever. In operation, the relative position between the stationary front jaw and the movable front jaw is adjusted by turning the adjusting screw rod so as to hold an object between the stationary front jaw and the movable front jaw. The movable front jaw is subsequently moved toward the stationary front jaw to tightly clamp the object therebetween by forcefully bringing the movable handle and the stationary handle together. The movable front jaw and the stationary front jaw remain locked until the movable handle and the stationary handle are forcefully separated by pivoting the releasing lever upwardly toward the adjusting screw rod.

The releasing lever has a rear end portion disposed below and aligned with a rear end portion of the adjusting screw rod such that when the releasing lever is pivoted upwardly toward the adjusting screw rod, the rear end portion of the releasing lever and the rear end portion of the adjusting screw rod cooperate with each other to define a gap therebetween. Since the rear end portion of the releasing lever has a U-shaped cross-section, which is cut along a transverse direction relative to the length of the releasing lever, and has a width that is about the same as the diameter of the rear end portion of the adjusting screw rod, there is a tendency for the fingers of the user to be pinched by the releasing lever when the releasing lever is pivoted upwardly toward the adjusting screw rod to unlock the movable front jaw and the stationary front jaw.

SUMMARY OF THE INVENTION

Therefore, the object of the present invention is to provide locking pliers with a releasing lever that is capable of overcoming the aforesaid drawback of the prior art.

According to the present invention, there is provided locking pliers that includes a stationary front jaw, a stationary handle extending rearwardly from the stationary front jaw, a movable front jaw disposed below and aligned with the stationary front jaw and pivoted to the stationary handle, a movable handle pivoted to and extending rearwardly from the movable front jaw, an adjusting screw rod engaging threadedly a rear end of the stationary handle and having a rear end portion that extends outwardly from the rear end of the stationary handle, a locking lever pivoted to the movable handle and extending rearwardly and upwardly therefrom toward the rear end of the stationary handle to abut against a front end of the adjusting screw rod, and a biasing member interconnecting the movable front jaw and the stationary handle. The movable front jaw is moved toward the stationary front jaw to clamp an object therebetween when the movable handle and the stationary handle are forcefully brought together by an external force applied thereto. The movable front jaw and the stationary front-jaw remain locked until the movable handle and the stationary handle are forcefully separated. The locking pliers further include a releasing lever pivoted to and extending rearwardly and upwardly from the movable handle toward the rear end portion of the adjusting screw rod. The releasing lever has a front end that is pivoted to the movable handle, a protrusion that is disposed adjacent to the front end and that abuts against the locking lever, and a rear end portion that is opposite to the front end and that is disposed below and aligned with the rear end portion of the adjusting screw rod. The rear end portion of the releasing lever has a flex wall body that defines a trough which is aligned with and which opens toward the rear end portion of the adjusting screw rod. The flex wall body has a substantially flat central portion defining a bottom side of the trough, and two opposite curved side portions flaring curvedly and upwardly from the flat central portion to define two opposite sides of the trough. The flat central portion has a width in a transverse direction relative to the length of the releasing lever. The width is larger than the diameter of the rear end portion of the adjusting screw rod.

BRIEF DESCRIPTION OF THE DRAWINGS

In drawings which illustrate an embodiment of the invention.

DETAILED DESCRIPTION OF THE PREFERRED EMBODIMENT

Figure 1:
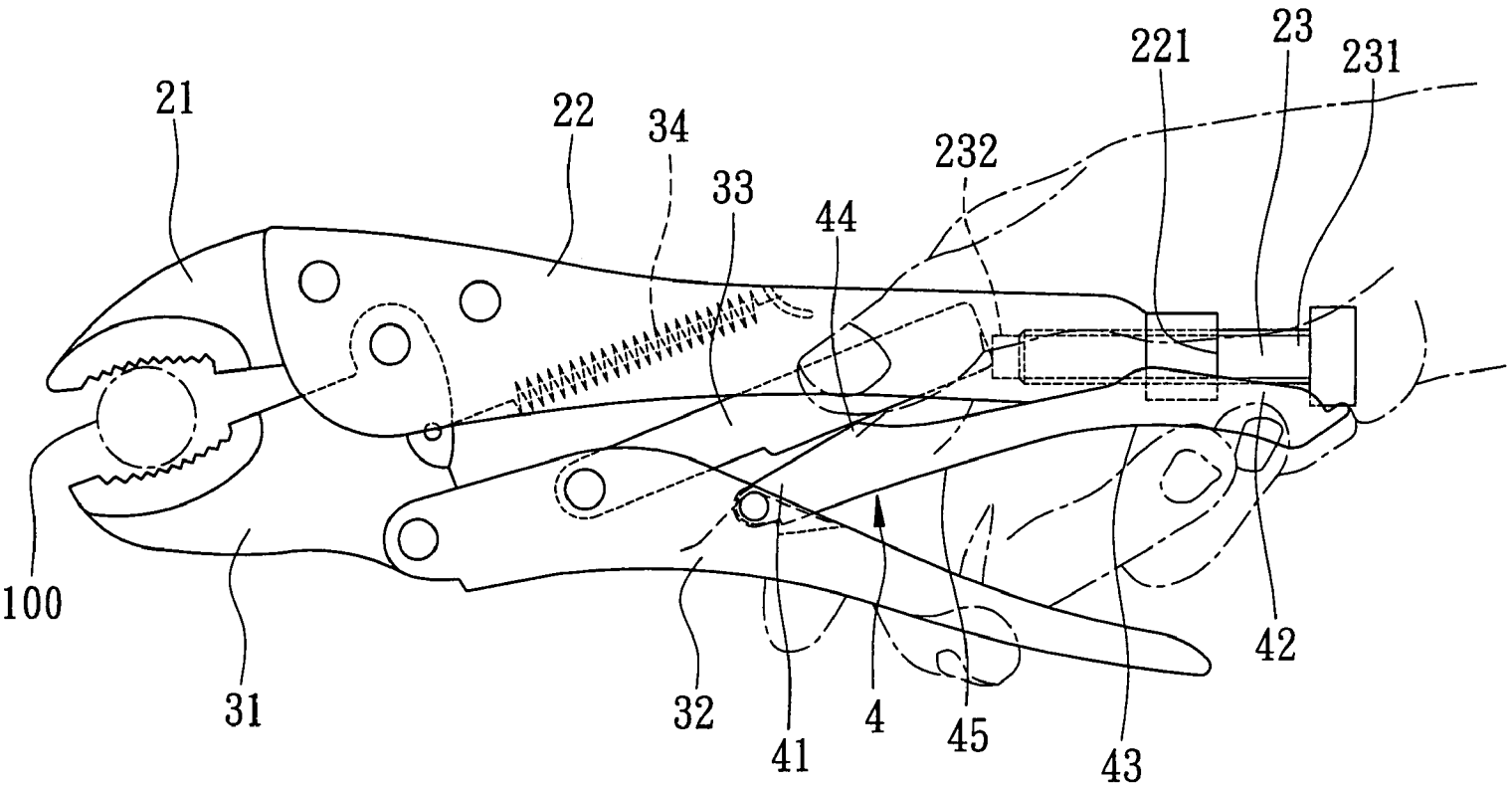
FIG. 1 is a side view of the preferred embodiment of locking pliers according to this invention.
Figure 2:
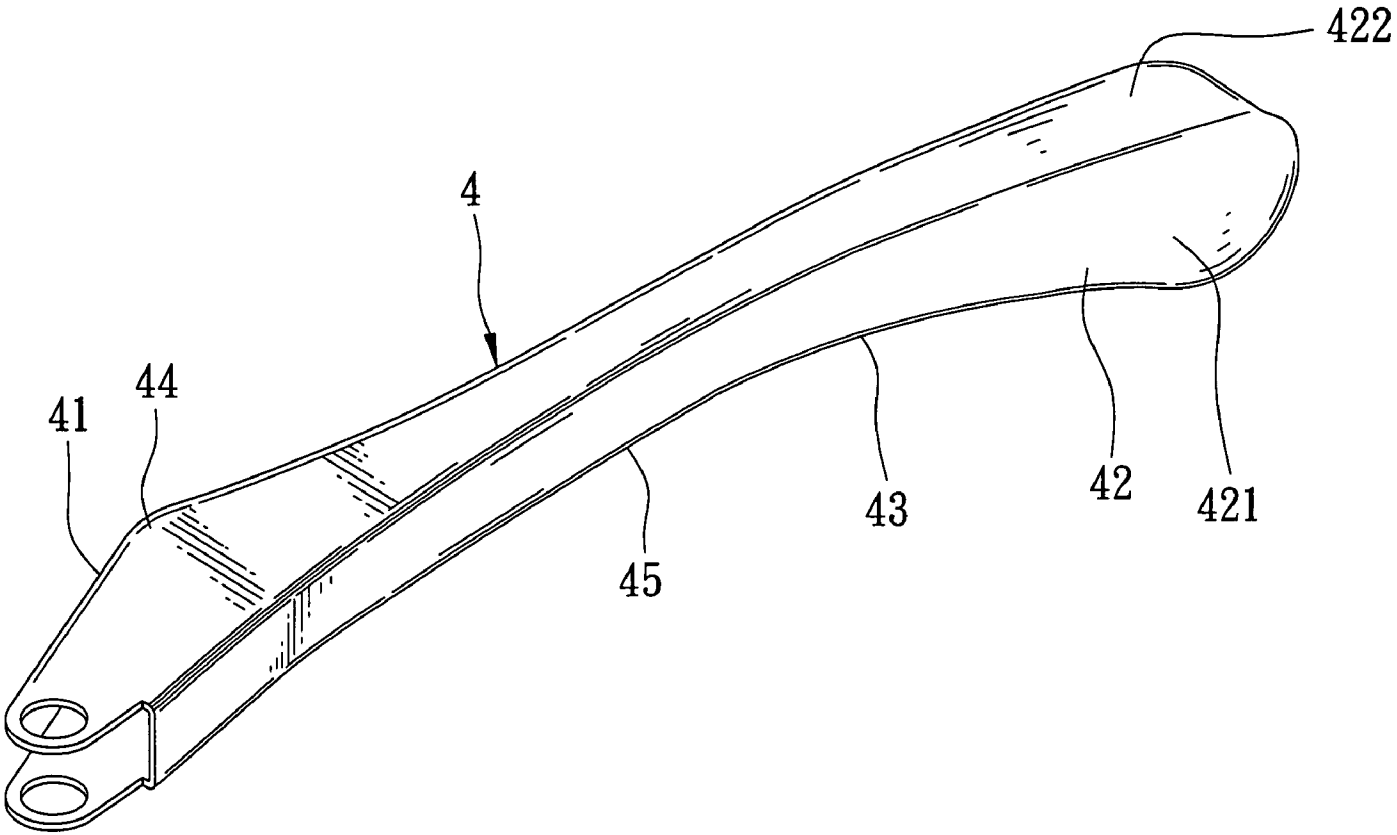
FIG. 2 is a perspective view of a releasing lever of the embodiment of this invention.
Figure 3:
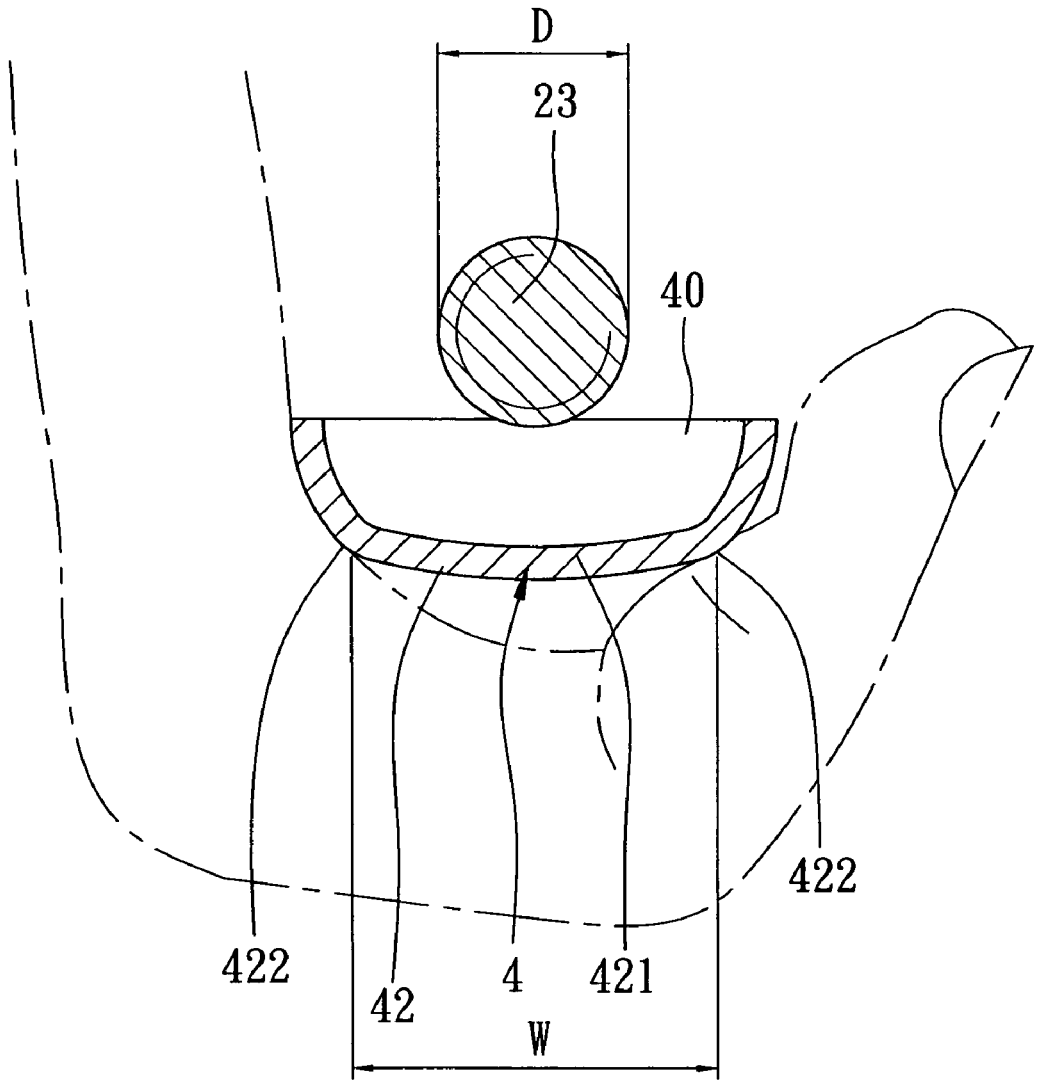
FIG. 3 is a sectional view to illustrate how pinching of the user's fingers is avoided when the releasing lever is pivoted toward an adjusting screw rod.

FIGS. 1 to 3 illustrate the preferred embodiment of locking pliers according to this invention.

The locking pliers include: a stationary front jaw 21, a stationary handle 22 extending rearwardly from the stationary front jaw 21, a movable front jaw 31 disposed below and aligned with the stationary front jaw 21 and pivoted to the stationary handle 22, a movable handle 32 pivoted to and extending rearwardly from the movable front jaw 31, an adjusting screw rod 23 engaging threadedly a rear end 221 of the stationary handle 22 and having a rear end portion 231 that extends outwardly from the rear end 221 of the stationary handle 22, a locking lever 33 pivoted to the movable handle 32 and extending rearwardly and upwardly therefrom toward the rear end 221 of the stationary handle 22 to abut against a front end 232 of the adjusting screw rod 23, and a biasing member 34 interconnecting the movable front jaw 31 and the stationary handle 22. The movable front jaw 31 is moved toward the stationary front jaw 21 to clamp an object 100 therebetween when the movable handle 32 and the stationary handle 22 are forcefully brought together by an external force applied thereto. The movable front jaw 31 and the stationary front jaw 21 remain locked until the movable handle 32 and the stationary handle 22 are forcefully separated. The locking pliers further include a releasing lever 4 pivoted to and extending rearwardly and upwardly from the movable handle 32 toward the rear end portion 231 of the adjusting screw rod 23. The releasing lever 4 has a front end 41 that is pivoted to the movable handle 32, a protrusion 44 that is disposed adjacent to the front end 41 and that abuts against the locking lever 33, and a rear end portion 42 that is opposite to the front end 41 and that is disposed below and aligned with the rear end portion 231 of the adjusting screw rod 23. The rear end portion 42 of the releasing lever 4 has a flex wall body that defines a trough 40 which is aligned with and which opens toward the rear end portion 231 of the adjusting screw rod 23. The flex wall body has a substantially flat central portion 421 defining a bottom side of the trough 40, and two opposite curved side portions 422 flaring curvedly and upwardly from the flat central portion 421 to define two opposite sides of the trough 40. The flat central portion 421 has a width (W) in a transverse direction relative to the length of the releasing lever 4. The width (W) is larger than the diameter (D) of the rear end portion 231 of the adjusting screw rod 23.

The releasing lever 4 has a straight portion 45 pivoted to and extending rearwardly and upwardly from the movable handle 32 toward the rear end portion 231 of the adjusting screw rod 23. The rear end portion 42 of the releasing lever 4 extends and is slightly bent from the straight portion 45 in a downward direction so as to define a shallow recess 43 therebetween and so as to facilitate upward turning of the releasing lever 4.

By virtue of the configuration of the releasing lever 4, the user's fingers are spaced far away from the rear end portion 231 of the adjusting screw rod 23 by the rear end portion 42 of the releasing lever 4, as best illustrated in FIG. 3. As such, the aforesaid drawback as encountered in the prior art can be eliminated.

With the invention thus explained, it is apparent that various modifications and variations can be made without departing from the spirit of the present invention.

I claim:

1. Locking pliers including a stationary front jaw, a stationary handle extending rearwardly from the stationary front jaw, a movable front jaw disposed below and aligned with the stationary front jaw and pivoted to the stationary handle, a movable handle pivoted to and extending rearwardly from the movable front jaw, an adjusting screw rod engaging threadedly a rear end of the stationary handle and having a rear end portion that extends outwardly from the rear end of the stationary handle, a locking lever pivoted to the movable handle and extending rearwardly and upwardly therefrom toward the rear end of the stationary handle to abut against a front end of the adjusting screw rod, and a biasing member interconnecting the movable front jaw and the stationary handle, the movable front jaw being moved toward the stationary front jaw to clamp an object therebetween when the movable handle and the stationary handle are forcefully brought together by an external force applied thereto, the movable front jaw and the stationary front jaw remaining locked until the movable handle and the stationary handle are forcefully separated, the locking pliers being characterized by:

a releasing lever pivoted to and extending rearwardly and upwardly from the movable handle toward the rear end portion of the adjusting screw rod, the releasing lever having a front end that is pivoted to the movable handle, a protrusion that is disposed adjacent to the front end and that abuts against the locking lever, and a rear end portion that is opposite to the front end and that is disposed below and aligned with the rear end portion of the adjusting screw rod, the rear end portion of the releasing lever having a flex wall body that defines a trough which is aligned with and which opens toward the rear end portion of the adjusting screw rod, the flex wall body having a substantially flat central portion defining a bottom side of the trough, and two opposite curved side portions flaring curvedly and upwardly from the flat central portion to define two opposite sides of the trough, the flat central portion having a width in a transverse direction relative to the length of the releasing lever, the width being larger than the diameter of the rear end portion of the adjusting screw rod.

2. The locking pliers of claim 1, characterized in that the releasing lever has a straight portion pivoted to and extending rearwardly and upwardly from the movable handle toward the rear end portion of the adjusting screw rod, the rear end portion of the releasing lever extending and being slightly bent from the straight portion in a downward direction so as to define a shallow recess therebetween.

* * * * *